United States Patent [19]

Mowbray

[11] 4,412,657

[45] Nov. 1, 1983

[54] FUEL INJECTION NOZZLES

[75] Inventor: Dorian F. Mowbray, Burnham, England

[73] Assignee: Lucas Industries Limited, Birmingham, England

[21] Appl. No.: 274,204

[22] Filed: Jun. 16, 1981

[30] Foreign Application Priority Data

Jul. 18, 1980 [GB] United Kingdom ..... 8023517

[51] Int. Cl.[3] ..... F02M 61/20

[52] U.S. Cl. ..... 239/533.9; 239/124

[58] Field of Search ..... 239/124, 125, 533.2–533.11, 239/549, 444

[56] References Cited

U.S. PATENT DOCUMENTS 1,494,020 5/1924 Riehm ..... 239/549 X 3,146,949 9/1964 Reiners ..... 239/533.7 X 3,398,936 8/1968 Delano ..... 239/533.11

3,425,635 2/1969 Guertler ..... 239/533.11 X

*Primary Examiner*—John J. Love

*Assistant Examiner*—Paul A. Sobel

[57] ABSTRACT

A fuel injection nozzle for supplying fuel to an internal combustion engine includes a fuel pressure actuated valve member slidable within a bore. The working clearance defined between the co-operating surfaces of the valve member and bore at one end communicates in use with a source of fuel under pressure which may not have adequate lubricity to provide proper lubrication of the surfaces. A groove is defined between the surfaces and communicates with a drain and the other end of the working clearance communicates in use with a source of lubricating medium.

4 Claims, 2 Drawing Figures

FUEL INJECTION NOZZLES

This invention relates to fuel injection nozzles for supplying liquid fuel to an internal combustion engine and of the kind comprising a nozzle body in which is defined a blind bore, an orifice or orifices communicating with the blind end of the bore, a seating defined adjacent the blind end of the bore, a valve member slidable within the bore and shaped at its inner end for co-operation with said seating, a fuel passage leading to a space surrounding the valve member, the valve member defining a surface exposed to the fuel pressure in said space whereby when fuel under pressure is supplied through said passage, a force will act upon the valve member to lift the valve member from the seating to permit flow of fuel through said orifice or orifices from said space.

Such nozzles are well known in the art and where the nozzle is to supply fuel to a diesel engine adequate lubrication of the surfaces of the bore and nozzle takes place when normal fuel is used, by virtue of the leakage of fuel from said space along the working clearance between the surfaces of the bore and the nozzle. The leakage fuel collects in a chamber and is usually returned to the fuel tank or the inlet of the fuel pump. If fuels of a lower lubricity are used then problems can arise due to scuffing of the surfaces which leads to rapid deterioration of the nozzle. In some countries there are ample supplies of such fuel and the object of the present invention is to provide a fuel injection nozzle of the kind specificed which can be used to supply such fuels to an engine, without damage.

According to the invention in a fuel injection nozzle of the kind specified a groove is defined between the co-operating surfaces of the valve member and the bore, and means is provided to supply lubricating medium to the working clearance defined between said co-operating surfaces at the end thereof remote from the seating, said groove acting to collect fuel leaking in one direction along the working clearance and lubricating medium leaking along the working clearance in the other direction.

Figure 1:
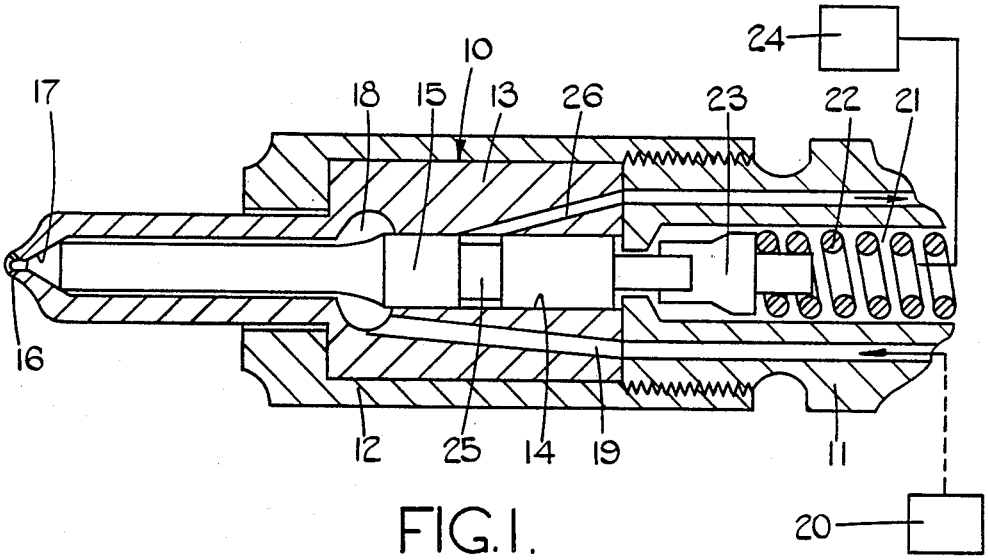
Figure 2:
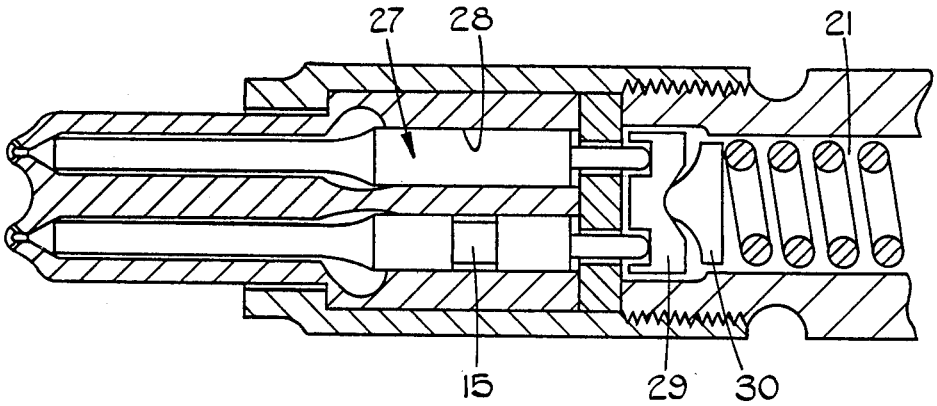

Examples of fuel injection nozzles in accordance with the invention will now be described with reference to the accompanying drawings in which:

FIG. 1 is a sectional side elevation showing part of one example of a nozzle unit utilised to supply fuel to a compression ignition engine; and FIG. 2 is a view similar to FIG. 1 showing a modification.

Referring to FIG. 1 of the drawings the nozzle unit includes a fuel injection nozzle generally indicated at 10 and which is secured to a nozzle support body 11 by means of a cap nut 12. The nozzle has a body part 13 of stepped cylindrical form, the narrower portion of which extends through an aperture in the cap nut. The body part is provided with a blind bore 14 in which is slidable a valve member 15. The blind end of the bore communicates with outlet orifices 16 and a seating 17 is defined adjacent the blind end of the bore. The valve member is shaped to co-operate with the seating to prevent flow of fuel from an annular space defined about a portion of the valve member and the bore. The space communicates with a groove 18 to which in use, fuel under pressure is supplied by way of a passage 19. This passage by way of a communicating passage in the nozzle holder, communicates with a high pressure fuel pump 20.

Defined in the holder is a chamber 21 in which is located a coiled compression spring 22 one end of which is located against an adjustable abutment (not shown) housed within the chamber 21 and the other end of which bears against an abutment 23 carried upon a reduced end portion of the valve member.

The operation of the nozzle unit thus far described is well known and when fuel under pressure from the fuel pump 20 is admitted to the groove 18, the pressure acts upon the valve member 15 to urge same against the action of a spring 22. Such movement lifts the valve member from the seating to permit fuel flow from the orifice 16. Where the fuel is normal diesel fuel the fuel which flows along the working clearance between the surface of the valve member 15 and the surface of the bore 14, will act as a lubricant and the fuel will collect in the chamber 21 and is usually returned either to the fuel tank from which the pump 20 draws its fuel, or to the inlet of the pump.

Where the fuel is a low grade fuel having poor lubricity, there is a risk of scuffing of the aforesaid surfaces which may lead to seizure of the valve member or excessive wear such that the working clearance is substantially increased to the point where little fuel passes through the outlet orifices 16.

In order to provide some measure of lubrication, a lubricating medium is supplied to the chamber 21 from a source 24. The lubricating medium may be oil and it will be supplied to the chamber at a low pressure since the pressure of the oil will act upon the valve member to assist the action of the spring 22. Since the fuel in the groove 18 will at regular periods, be at a high pressure, there would be a tendency for the fuel to flow into the chamber 21 as in the conventional nozzle units. In order to prevent this, the valve member is provided with a groove 25 and this groove communicates with a passage 26 formed in the body part 13 and continuing by way of a passage in the holder 11. Fuel leaks into the groove 25 from one direction and oil leaks into the groove from the other direction the resulting mixture is conveyed to a suitable receptacle. In this manner lubrication of at least a substantial portion of the valve member and bore is provided so that the risk of seizure is reduced.

In the arrangement shown in FIG. 2 a further valve member 27 is provided and this is slidable within a further bore 28 defined in the nozzle body. The two valve members project into the chamber 21 and engage a beam 29 which is engaged by a modified form of spring abutment 30. The further valve member is utilised to supply a pilot quantity of good fuel, say for example normal diesel fuel and as such no special lubrication is required. The valve member 15 is utilised to supply the fuel of lower lubricity generally an inferior form of fuel. This therefore requires the special lubrication arrangement outlined above. By virtue of the beam 29 the two valve members can be opened independently of each other.

I claim:

1. A fuel injection nozzle for supplying liquid fuel to an internal combustion engine and of the kind comprising a nozzle body in which is defined a blind bore, an orifice or orifices communicating with the blind end of the bore, a valve seat defined adjacent the blind end of the bore, a valve member slidable within the bore and shaped at its inner end for co-operation with said valve seat, a fuel passage leading to a space surrounding the valve member, the valve member defining a surface exposed to the fuel pressure in said space whereby when fuel under pressure is supplied through said passage, a force will act upon the valve member to lift the valve member from the valve seat to permit flow of fuel through said orifice or orifices from said space, a single groove defined between the co-operating surfaces of the valve member and the bore, and means for supplying lubricating medium to the working clearance defined between said co-operating surfaces, said means for supplying lubricating medium suppling the lubricating medium at the end of the working clearance remote from the valve seat, said groove acting to collect fuel leaking in one direction along the working clearance and lubricating medium leaking along the working clearance in the other direction.

2. A nozzle according to claim 1 including a holder, means securing the nozzle body to the holder, a chamber defined in said holder, and resilient means in said chamber, said resilient means acting to urge the valve member into contact with the valve seat.

3. A nozzle according to claim 2 in which the lubricating medium is supplied to said chamber.

4. A nozzle according to claim 3 including a further valve member slidable with a further bore in the nozzle body, a further outlet the fuel flow through which is controlled by said further valve member, and a further fuel inlet through which fuel of adequate lubricity can be supplied for discharge through said further outlet.

* * * * *